US005784851A

United States Patent [19]

Waugh

[11] Patent Number: 5,784,851

[45] Date of Patent: Jul. 28, 1998

[54] CENTRIFUGALLY CAST POLE AND METHOD

[76] Inventor: Tom W. Waugh, 1701 31st Pl., SW., Birmingham, Ala. 35221

[21] Appl. No.: 636,389

[22] Filed: Apr. 23, 1996

[51] Int. Cl.[6] ..... E04C 3/36

[52] U.S. Cl. ..... 52/736.1; 52/726.4; 405/249

[58] Field of Search ..... 405/231, 249, 405/251; 52/721.2, 722.1, 726.4, 736.2, 736.1, 732.3, 731.4; D25/126–135

[56] References Cited

U.S. PATENT DOCUMENTS

| | | | |
|---|---|---|---|
| Re. 31,482 | 1/1984 | Noble | 164/114 |
| 122,656 | 1/1872 | Rogers | 52/726.4 |
| 822,499 | 6/1906 | Ancona | 52/721.2 X |
| 890,373 | 6/1908 | Orr | 52/721.2 X |
| 2,623,809 | 12/1952 | Myers | 22/189 |
| 3,270,480 | 9/1966 | Beecker | D25/127 X |
| 3,791,154 | 2/1974 | Crain | 61/46 |
| 3,792,680 | 2/1974 | Allen | 116/173 |
| 3,813,837 | 6/1974 | McClain et al. | 52/309 |
| 3,853,418 | 12/1974 | Druin et al. | 52/726.4 X |
| 3,936,206 | 2/1976 | Meisberger | 52/726.4 X |
| 4,388,787 | 6/1983 | Milbright | 52/298 |
| 4,448,610 | 5/1984 | Bellocci | 148/3 |
| 4,570,698 | 2/1986 | Kollberg | 164/498 |
| 4,751,804 | 6/1988 | Cazaly | 52/721.2 |
| 5,175,971 | 1/1993 | McCombs | 52/726.4 X |
| 5,343,930 | 9/1994 | Yagi et al. | 164/295 |
| 5,492,579 | 2/1996 | Hosford et al. | 156/64 |
| 5,513,477 | 5/1996 | Farber | 52/726.4 |

FOREIGN PATENT DOCUMENTS

| | | | |
|---|---|---|---|
| 693708 | 9/1964 | Canada | 52/726.4 |

*Primary Examiner*—Tamara L. Graysay
*Assistant Examiner*—Frederick Lagman
*Attorney, Agent, or Firm*—Wm. Randall May

[57] ABSTRACT

A hollow, centrifugally cast, utility pole having tapered external linear dimensions is disclosed. The pole is formed utilizing conventional centrifugal casting methods wherein a tapered mold is used to impart a tapered shape to the pole. The use of the tapered mold during the casting operation also provides for a gradually increasing pole wall thickness along the entire length of the pole from the top of the pole to its butt. The pole can also be cast to provide for a press-fit, slip joint at the butt of the pole which allows the pole to be interconnected with other similarly cast poles for extended height.

5 Claims, 3 Drawing Sheets

CENTRIFUGALLY CAST POLE AND METHOD

BACKGROUND OF THE INVENTION

This invention relates generally to hollow structural members and more specifically to hollow utility poles having tapered linear dimensions.

The geometric shape of tapered poles in high stress, high lateral force environments typically encountered in the utility industry is very important in that such configuration inherently provides the greatest cross-sectional strength at or near the base of the pole where reactive forces tend to combine and converge.

Problems associated with the use of wooden poles within the utility industry are numerous and well documented. These problems include ground line decay, the tendency of wooden poles to bend or arc under high lateral forces thereby requiring the use of guying cables, anchors and other auxiliary hardware, deterioration caused by birds and other animals, vibration damage to attached hardware and fixtures, shortages of suitable trees for producing large poles, and high breakage rate due to natural and manmade forces. Additionally, wooden poles as a general rule must be replaced after approximately 20–30 years of service as a result of natural deterioration. Some utility companies have resorted to wrapping their wooden poles in wire mesh to prevent damage to the poles by birds and other animals. Other companies have resorted to using solid concrete poles, particularly with regard to high voltage electric transmission systems, in order to overcome some of the difficulties associated with wooden poles. Concrete utility poles, however, are expensive to produce, are very heavy and require special heavy duty equipment to load, transport, unload and install. Also, field modifications of concrete poles are generally very time consuming, cumbersome and thus very costly.

Steel poles are currently available in the market, however, these poles, for a number of reasons, including cost factors and casting controls, are not, and cannot be, centrifugally cast in sufficient length for pole formation. Steel poles are typically produced by cutting relatively thin steel plates and forming the plates, using metal brakes and other hot and/or cold metal shaping methods, into two multi-sided halves which are then welded together. Such poles are quite expensive to produce and, as a consequence of the thin walls necessary to form them, result in poles having relatively large base diameters in order to achieve the necessary strength to be used in high stress, high lateral force situations.

Aluminum alloy utility poles for low stress projects, such as highway lighting standards, are also available. However, these poles cannot be formed by centrifugal casting methods and are typically produced by hot or cold metal shaping methods. Moreover, these poles do not have the necessary qualities or strength to be used in high lateral force environments.

There is no history of the use of ductile iron for utility pole purposes, however, such material, if centrifugally cast into a hollow, tapered geometric shape as proposed and claimed by applicant herein, would provide a virtually maintenance free, extremely long life (many 100+ year old cast iron water mains are still in use), low cost utility pole which effectively overcomes the problems and difficulties associated with other utility poles as discussed hereinabove.

SUMMARY OF THE INVENTION

In view of the foregoing, it is a primary object of this invention to provide a centrifugally cast pole having tapered linear dimensions.

According to an embodiment of the invention, a hollow pole is formed utilizing conventional centrifugal casting methods whereby the cross-sectional dimensions of the pole are varied uniformly so as to impart a tapered shape to the pole.

It is an object of the present invention to provide a hollow, tapered utility pole which is easy and economical to produce having a wall thickness which can be varied to accommodate virtually any application and any strength requirement.

An important advantage of the present invention is the provision of a centrifugally cast tapered pole wherein the wall thickness near the butt of the pole is sufficient to accommodate the formation, during the casting operation, of a slip joint having internal cross-sectional dimensions sufficient to allow the pole to slidably receive the top portion of another centrifugally cast pole thereby providing for virtually unlimited pole extensions.

Another important advantage of the present invention is the centrifugal casting of poles utilizing metallic materials such as ductile iron thereby rendering the pole virtually maintenance free and impervious to groundline decay, fungus, humidity, animal damage and other causes of deterioration.

A further advantage of the present invention is that a pole centrifugally cast of ductile iron would be comparatively lightweight, would have the physical strength of mild steel with the long life expectancy of grey cast iron, would be virtually unbreakable in ordinary service and would be 100% salvageable.

Yet another advantage of the present invention is that a pole centrifugally cast of ductile iron would offer the greatest possible margin of safety against service failure due to ground movement and beam stresses and, due to the tough characteristics of ductile iron, would provide increased resistance to breakage caused by handling, shipping and installation.

The invention is particularly advantageous in that a pole centrifugally cast can be direct buried or may be flanged for attachment to poured or preformed foundations.

A further advantage of the present invention is that the hollow design of a centrifugally cast utility pole allows for internal wiring of fixtures and other attachments to said pole.

BRIEF DESCRIPTION OF THE DRAWINGS

The foregoing and other objects, features, and advantages of the present invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
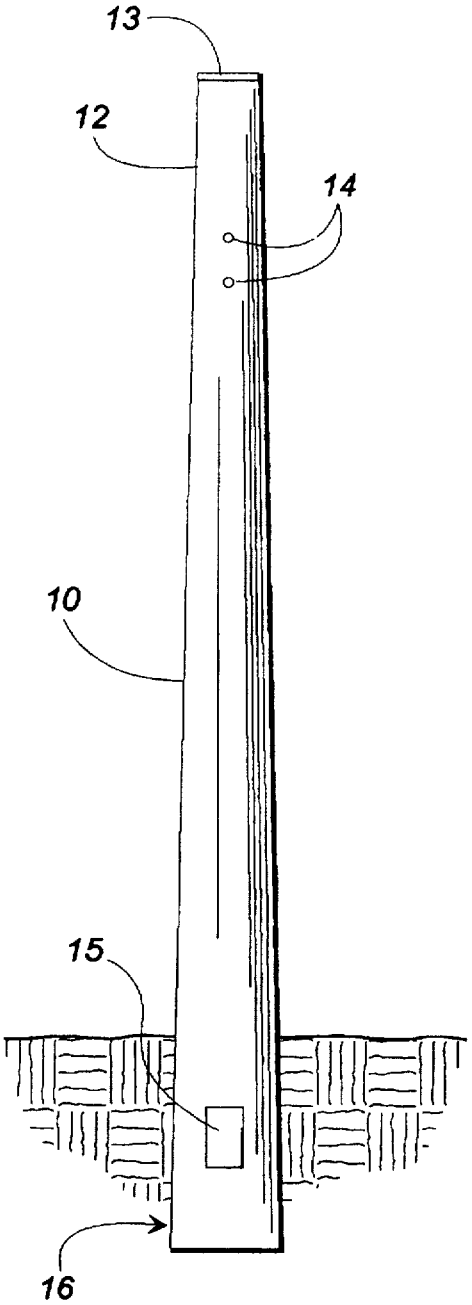
FIG. 1 is a side view of an embodiment of the invention showing the invention in a direct burial configuration.
Figure 2:
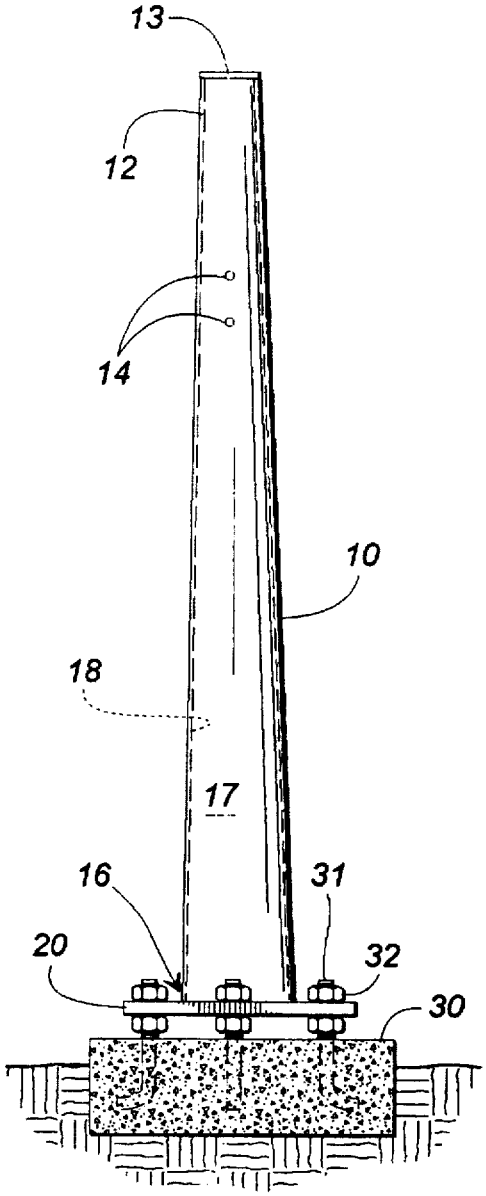
FIG. 2 is a side view of the embodiment of FIG. 1 showing the invention in a flanged, base or foundation-mounted, configuration.
Figure 4:
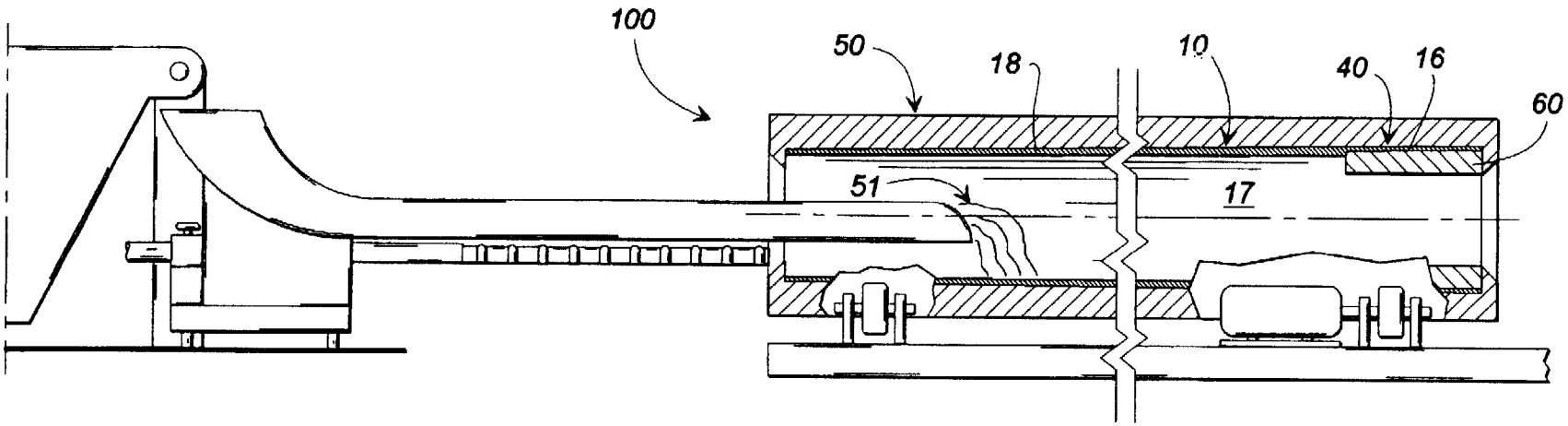
FIG. 4 is a diagrammatic view of a typical centrifugal casting machine being used to cast an embodiment of the invention. Also shown, in partial longitudinal section, is the tapered mold and slip joint core of the invention.

FIG. 1 shows a hollow, centrifugally cast, utility pole 10 shown in a direct burial configuration according to an embodiment of the invention. FIG. 2 shows the invention in a pedestal or foundation-mounted configuration according to a second embodiment of the invention. The pole 10 of FIGS. 1 and 2 has been centrifugally cast in a manner which imparts a tapered shape to the external linear dimensions of the pole 10 from pole butt 16 to pole top 12 as shown. The tapered shape of the pole 10 gives the pole 10 added strength and also saves raw materials during the casting operation. The embodiments of FIGS. 1 and 2 further comprise a pole cap 13 and pre-drilled or field modified holes 14 for attachment of typical utility pole hardware and fixtures. Also shown in the embodiment of FIG. 1 is an access panel 15. Said panel 15 is located near the bottom of the pole 10 and provides access to the hollow interior or core 17 of the pole 10 in situations where internal hardware such as cables or wires have been installed within said hollow core 17. The centrifugal casting of the tapered pole 10 provides for the controlled and gradual thickening of the pole wall 18 along the entire length of the pole 10 whereby the wall thickness imparted to the pole 10 is progressively and uniformly increased from pole top 12 to pole butt 16. This controlled gradient of wall 18 thickness provides greater cross sectional strength to the pole 10 in its bottom portion where the greatest pole strength is desired. In the preferred embodiment, an internally tapered chill-type mold 50, as shown in FIG. 4, is used to impart a tapered external shape to the pole 10. Depending on the particular application and strength required of the pole 10, the overall wall 18 thickness of the pole 10 may be varied during the casting operation by the amount of casting material 51 allowed to enter the centrifugal casting mold 50.

The pole 10 shown in FIG. 2 is provided with a flange 20 at its butt 16 to enable the pole 10 to be mounted and secured to a foundation 30 or other pedestal-type apparatus. In this embodiment, the pole 10 is shown secured to the foundation 30 by a plurality of bolts 31 and nuts 32.

Figure 3:
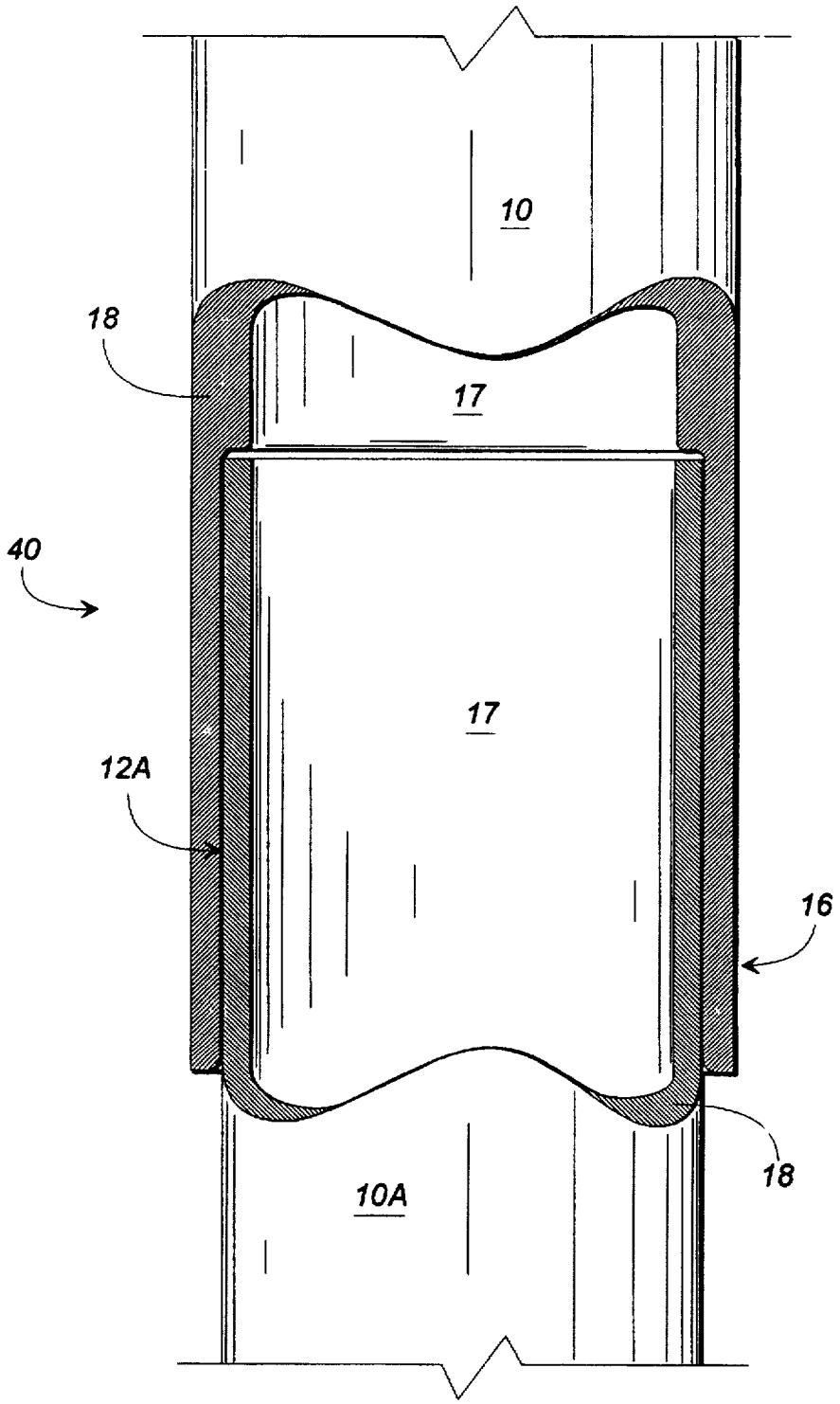
FIG. 3 is a side view of the invention, partially sectioned, showing the slip joint design of the invention used for extended height.

FIG. 3 shows the press-fit, slip-joint 40 configuration of the invention used to interconnect two or more cast pole 10 sections for extended height. The slip-joint 40 comprises a tapered, centrifugally cast, utility pole 10, according to the invention, wherein the internal core 17 diameter of the pole 10, beginning at the butt 16 of the pole 10 and extending internally linearly along a portion of the length of the pole 10, has been cast to have internal dimensions which allow the butt 16 of the pole 10 to slidably engage the top portion 12A of another centrifugally cast tapered pole 10A. Such interconnection provides for virtually unlimited extensions of pole 10 height.

FIG. 4 shows a typical centrifugal casting machine 100 being used to cast an embodiment of the invention. An internally tapered mold 50 is used to provide the overall tapered geometric shape of the pole 10 during the centrifugal casting operation. Said mold 50 is similar to conventional centrifugal casting molds with the exception of the tapered internal linear dimensions of the mold 50 as shown in the longitudinal cross-section of FIG. 4. The lateral cross section of the mold 50 in the embodiment of FIG. 4 is generally circular in form, however, the internal surface of the mold 50 could be modified to produce tapered poles having multi-sided dimensions such as poles with generally square or polygonal cross-sections.

A sand core mold 60 used to form the slip-joint 40 of the invention during the centrifugal casting process is also shown in FIG. 4. When desired, said sand core mold 60 is inserted into the mold 50 at the butt 16 of the pole 10 being centrifugally cast. When present during the centrifugal casting operation, the sand core mold 60 causes the core 17 diameter of the cast pole 10 to be uniformly and progressively increased along the length of said sand core mold 60. The core 17 diameter formed by the use of said sand core mold 60 during the centrifugal casting process is sufficient to enable the butt 16 of the pole 10 after casting to slidably engage the top portion 12A of another centrifugally cast pole 10A as shown in FIG. 3.

The tapered mold 50 also controls the external gradient or taper of the pole wall 18 along the length of the pole 10 as the pole 10 is being centrifugally cast. The overall thickness of the walls 18 of the pole 10 is controlled by the quantity of casting material 51, such as ductile iron or other castable material, allowed to enter the mold 50 during the casting operation.

While the invention has been particularly shown and described with reference to the preferred embodiments thereof, it will be understood by those skilled in the art that various alterations in form, detail and construction may be made therein without departing from the spirit and scope of the invention.

The embodiments of the invention in which an exclusive property right or privilege is claimed are defined as follows:

1. A centrifugally cast, ductile iron utility pole comprising:

an elongated, hollow pole member which is formed by centrifugal casting so as to have an externally tapered shape with said pole member having a variable wall thickness and having variable outside cross-sectional dimensions whereby said wall thickness and said outside cross-sectional dimensions vary perpendicularly to the member's long axis and where said variable wall thickness varies proportionately to said outside cross-sectional dimensions so that the wall thickness imparted to the member by the centrifugal casting operation is progressively and uniformly increased from one end of the member to the other.

2. The apparatus of claim 1, wherein one end of said member further comprises an end cap.

3. The apparatus of claim 1, wherein one end of said member is flanged.

4. A centrifugally cast ductile iron utility pole according to the product of claim 1 produced by a process comprising the steps of:

introducing molten ductile iron into a mold having internally tapered dimensions;

centrifugally rotating said tapered mold during the introduction of said molten ductile iron so as to proportionately and uniformly distribute said material over and along the tapered surface of said mold in a manner which imparts a progressively increased wall thickness to the forming pole member;

allowing said molten ductile iron to cool and harden within said mold; and, removing said hardened pole member from said mold.

5. The product of claim 4, wherein the process of producing said utility pole further comprises causing one end of said pole member to be flanged during the centrifugal casting operation.

* * * * *